US011580885B2

(12) United States Patent
Pries et al.

(10) Patent No.: US 11,580,885 B2
(45) Date of Patent: Feb. 14, 2023

(54) TAMPER PROOF SEAL ASSEMBLY

(71) Applicant: Honeywell International Inc., Morris Plains, NJ (US)

(72) Inventors: Henning Pries, Lotte (DE); August Wallmeyer, Recke (DE); Sandra Kreftsiek, Georgsmarienhütte (DE); Hans-Werner Temme, Lotte (DE)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 626 days.

(21) Appl. No.: 16/582,900

(22) Filed: Sep. 25, 2019

(65) Prior Publication Data

US 2020/0105166 A1 Apr. 2, 2020

Related U.S. Application Data

(60) Provisional application No. 62/738,498, filed on Sep. 28, 2018.

(51) Int. Cl.
*G09F 3/03* (2006.01)
*E05B 65/00* (2006.01)
(Continued)

(52) U.S. Cl.
CPC ..... *G09F 3/0317* (2013.01); *B21J 15/046* (2013.01); *B65D 27/30* (2013.01); *B65D 55/02* (2013.01);
(Continued)

(58) Field of Classification Search
CPC ..... G09F 3/03; G09F 3/0305; G09F 3/0317; G09F 3/0341; G09F 2003/0276;
(Continued)

(56) References Cited

U.S. PATENT DOCUMENTS 1,037,010 A 8/1912 Irons
2,113,744 A 4/1938 Pixley et al.
(Continued)

FOREIGN PATENT DOCUMENTS

CN 104488014 A 4/2015
CN 205861149 U * 1/2017
(Continued)

OTHER PUBLICATIONS

PCT/US2019/053331, International Search Report & Written Opinion, pp. 7, dated Jan. 23, 2020.
(Continued)

*Primary Examiner* — Christine M Mills
*Assistant Examiner* — Peter H Watson
(74) *Attorney, Agent, or Firm* — Seager, Tufte & Wickhem, LLP

(57) ABSTRACT

A tamper proof locking mechanism incorporating a first fixture for attachment to an index protective cover, a second fixture for attachment to an instrument, and a third fixture for connecting the first fixture to the second fixture. The first fixture may have a receptacle, the second fixture may have a plate with an opening, and the third fixture may have a protrusive structure that fits into the receptacle of the first fixture and into the opening in the plate to connect the first fixture to the second fixture. The protrusive structure may have a rivet that is partially embedded with a plastic-like material that reveals tampering when an attempt is made to break a connection between the first fixture and the second fixture.

6 Claims, 11 Drawing Sheets

(51) Int. Cl.

| | |
|---|---|
| ***B65D 55/02*** | (2006.01) |
| ***B21J 15/04*** | (2006.01) |
| ***B65D 27/30*** | (2006.01) |
| ***E05B 39/02*** | (2006.01) |
| ***G09F 3/02*** | (2006.01) |

(52) U.S. Cl.
CPC ..... *E05B 39/02* (2013.01); *E05B 65/0089* (2013.01); *G09F 2003/0277* (2013.01)

(58) Field of Classification Search
CPC . G09F 2003/0277; B65D 27/30; B65D 55/00; B65D 55/02; B65D 55/024; B65D 55/028; B65D 55/06; B65D 55/10; E05B 39/00; E05B 41/00; E05B 65/0089; Y10T 292/48; Y10T 292/49; Y10T 292/491; Y10T 292/497; Y10T 292/51; B21J 15/046
See application file for complete search history.

(56) References Cited

U.S. PATENT DOCUMENTS

| | | | | | |
|---|---|---|---|---|---|
| 2,185,939 | A * | 1/1940 | Deshon | B21J 15/046 | 411/501 |
| 4,416,478 | A | 11/1983 | Canney | | |
| 4,609,217 | A | 9/1986 | Nielsen, Jr. et al. | | |
| 4,699,408 | A | 10/1987 | Kesselman | | |
| 4,978,266 | A * | 12/1990 | Becker | F16B 41/002 | 411/61 |
| 5,378,030 | A * | 1/1995 | Georgopoulos | E05B 65/0089 | 292/307 R |
| 5,487,293 | A * | 1/1996 | Lovejoy | B24D 13/06 | 72/53 |
| 8,149,119 | B2 | 4/2012 | Hanft | | |
| 10,431,127 | B2 | 10/2019 | Avalos et al. | | |
| 2013/0259598 | A1 | 10/2013 | Debrody et al. | | |

FOREIGN PATENT DOCUMENTS

| | | | | |
|---|---|---|---|---|
| CN | 205861149 U | 1/2017 | | |
| DE | 19704642 A1 * | 8/1998 | ..... | E05B 83/24 |
| WO | WO-2013148013 A1 * | 10/2013 | ..... | F16B 19/00 |

OTHER PUBLICATIONS

Chinese First Office Action, CN Application No. 201980065080 X, dated Aug. 23, 2021 (8 pages) (English translation attached, 7 pages).

* cited by examiner

TAMPER PROOF SEAL ASSEMBLY

This application claims the benefit of U.S. Provisional Patent Application Ser. No. 62/738,498, filed Sep. 28, 2018. U.S. Provisional Patent Application Ser. No. 62/738,498, filed Sep. 28, 2018, is hereby incorporated by reference.

BACKGROUND

The present disclosure pertains to security and protection of instrumentation such as meters for gas, electricity, water and so forth.

SUMMARY

The disclosure reveals a tamper proof locking mechanism incorporating a first fixture for attachment to an index protective cover, a second fixture for attachment to an instrument, and a third fixture for connecting the first fixture to the second fixture. The first fixture may have a receptacle, the second fixture may have a plate with an opening, and the third fixture may have a protrusive structure that fits into the receptacle of the first fixture and into the opening in the plate to connect the first fixture to the second fixture. The protrusive structure may have a rivet that is partially embedded with a plastic-like material that reveals tampering when an attempt is made to break a connection between the first fixture and the second fixture.

DESCRIPTION

Figure 1:
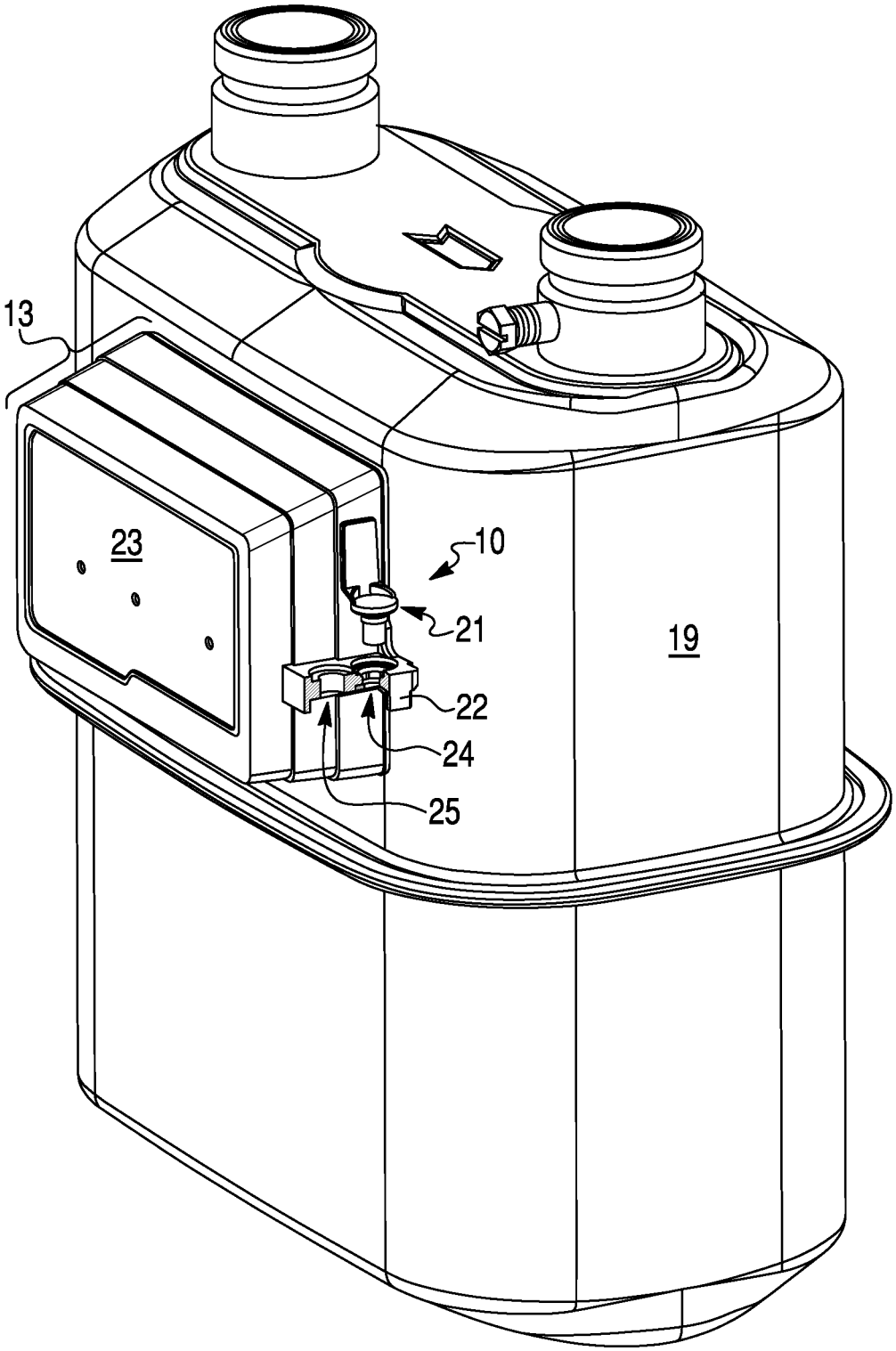
FIG. 1 is a diagram of a securing assembly associated with a meter and index.

The present system and approach may incorporate one or more processors, computers, controllers, user interfaces, wireless and/or wire connections, and/or the like, in an implementation described and/or shown herein.

This description may provide one or more illustrative and specific examples or ways of implementing the present system and approach. There may be numerous other examples or ways of implementing the system and approach.

In this case, meter or similar instrument indexes need to be sealed, to avoid tampering. Meters of concern relative to indexes may include various types of meters such as, for examples, gas meters, water meters, electric meters, and so on. This is currently done with lead seals that will not be allowed with electronic indexes in future, due to a RoHS (Restriction of Hazardous Substances) directive. Another opportunity is to do the sealing with plastic seals or seals of other material having similar properties, but those may have the disadvantage to be affected by environmental influences and time. The present approach may improve the quality of the seal and will also fulfill current directives.

This preset mechanism has a feature in that it may use the advantages of the prior used seals without harvesting the disadvantages.

A technical benefit is to have a seal that is compliant with RoHS directives and is easy to manually assemble by hand.

A business advantage is to have a seal that provides a higher degree of tamper protection than the competitors have. This is especially interesting for markets with lots of tamper attempts.

The present mechanism may be used with a "Smart Seal" approach. The "Seal" may be made in two ways. Either the tubular rivet may be put into an injection molding machine to attach the plastic-like material, or the plastic-like components may be welded and/or glued to the tubular rivet. The rivet may have another shape rather than a tubular shape, e.g., a square, triangular, varying shape, or other kind of shape or orientation.

When this is done, the seal may be put into the index and the baseplate, by riveting, the index may be connected and sealed to the meter or instrument. Due to an attached pressure, the sealing icon may be embossed to the plastic-like parts; depending on the use case, the plastic-like part of the seal may be molded in a way to enable embossing a symbol to the bottom of the seal as well. As a further feature, the plastic-like material may be made with marker technology which makes sure, that a duplication of the seal can be detected. Marker technology may be known or available in the market.

The present mechanism for sealing, for example, a meter via its index, may incorporate a molded tubular rivet seal. The rivet and seal may be another shape besides tubular. Currently implemented seals may be made of a soft material, which can have an advantage to make easy embossing on the seal by hand. Soft material may arguably also mean to be weak against tamper attempts. A presently new seal may join easy embossing with a strong rivet. The new seal may be stronger against tampering but may still be capable of easy assembly by hand.

The new seal may combine the advantages of two materials without harvesting the disadvantages Tamper attempts may remain visible on the new seal. The tabular rivet may be resistant to environmental influences—the index of the meter may be still sealed even when the plastic or plastic-like component has lost its original shape.

FIG. 1 is a diagram of the tamper proof seal assembly 10 having a rivet seal component 21 and receptacle component 22. Rivet seal component 21 may be plugged into receptacle component 22 for the sealing. Component 22 may be attached to index cover 13. Tamper proof seal assembly 10 may lock index cover 13 to gas meter 19. If rivet seal component 21 is not in an opening, receptacle or hole 24 of component 22, then index cover 13 and other index parts may be removed from meter 19 without evidence of any wrongful forcible removal. To break components 21 and 22 apart may result in clearly observable damage to assembly 10. The one or more components need not necessarily be circular or some apparently prescribed shape, but might be some other shape. The materials used in or with the components may be those that can help or actually achieve an operational tamper proof seal assembly as described herein.

Index cover 13 may have a window 23 through which one may look at, for example, counter wheels showing an amount of a consumed gas volume that flows through gas meter 19.

Component 22 may be part of or attached to index cover 13. Meter 19 may be sealed, and seal component 21 may lock index cover 13 via component 22 and a plate or clip with gas meter 19. Component 22 may be regarded in practicality as the same part of index cover 13. Besides receptacle, opening or hole 24 in component 22, there may be another receptacle, opening or hole 25 in component 22. Hole or receptacle 25 may be used for further attachments that are made on gas meter 19 such as remote reading devices; which if mounted, they should be connected to the index cover 13. This connection may be done with a second seal like that of the above-noted component 21.

Figure 2:
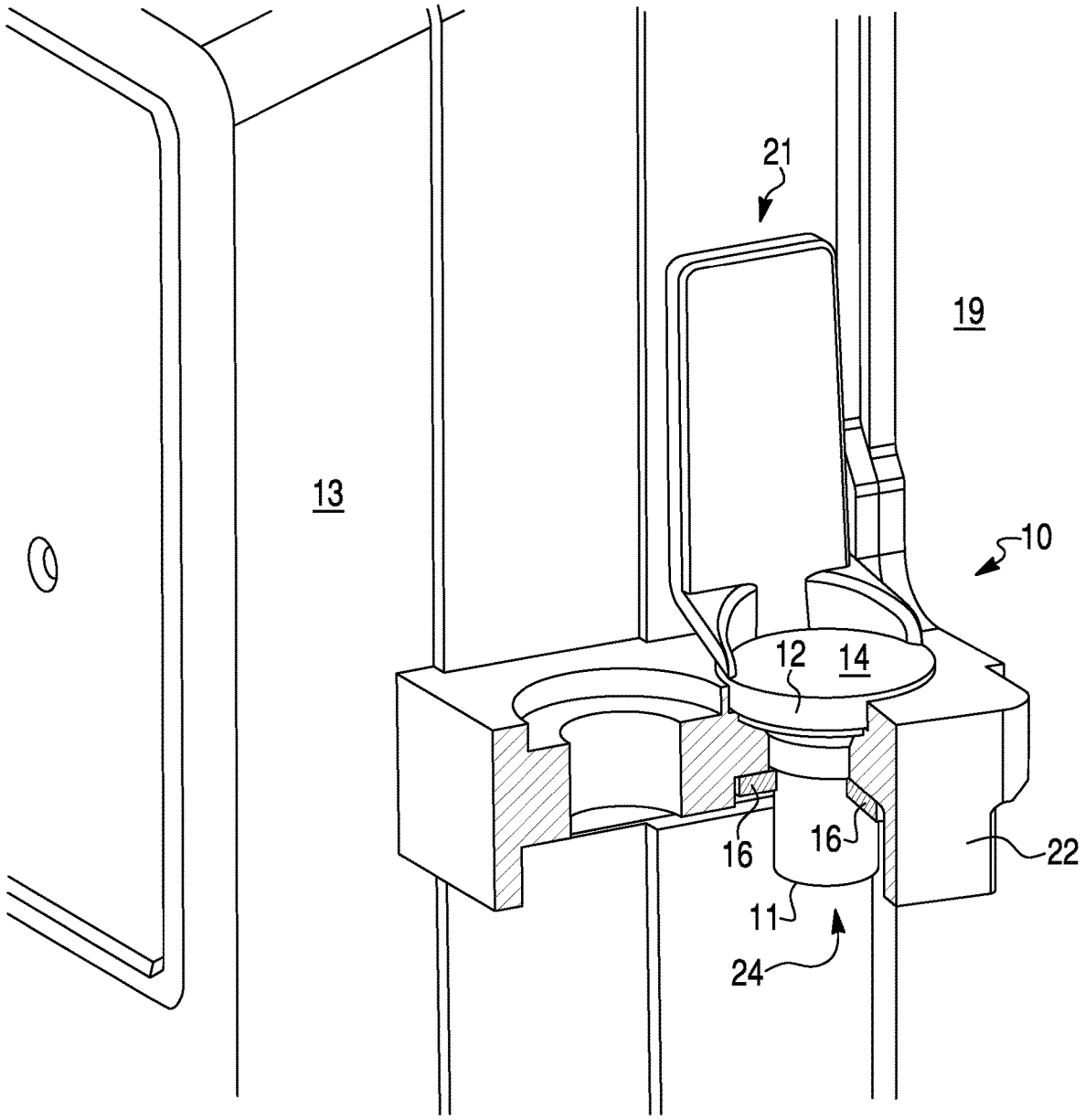
FIG. 2 is a top view diagram of a tamper proof rivet seal assembly for such things as meter indexes.

FIG. 2 is a top view diagram of a tamper proof rivet seal assembly 10 for such things as meter indexes. Components of seal assembly 10 may incorporate a tubular rivet 11, a malleable plastic or plastic-like item or structure 12 with a surface 14 for embossing. The seal assembly 10 may be attached to a meter index 13. Plastic-like material item 12 may be formed on rivet 11 before it is inserted in receptacle 24. Plastic-like item 12 may be an over mold within an injection molding process, but it could also be welded to the rivet 11.

Figure 3:
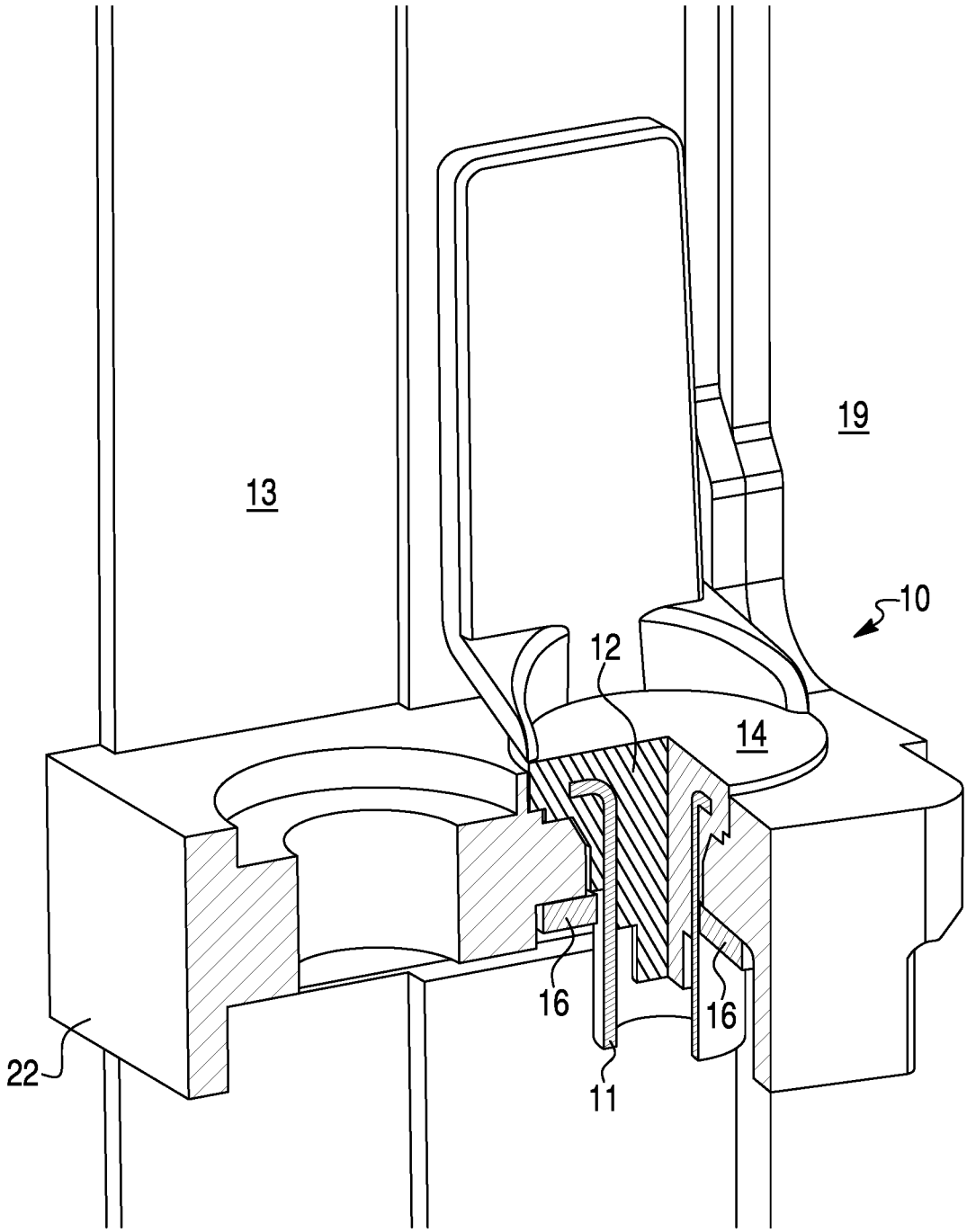
FIG. 3 is a diagram of a top view cut out of a seal assembly revealing a cut away view of a tubular rivet, and a plastic-like component or structure that holds an upper portion of the rivet in place.

FIG. 3 is a diagram of a top view cut out of seal assembly 10 revealing a cut away view of tubular rivet 11, and a plastic-like component or structure 12 that holds an upper portion of rivet 11 in place. A surface 14 on component 12 may be configured for embossing. Material of component 12 may consist of, for example, plastic, plastic-like, clay, clay-like, soft metal, soft metal-like, or other material having similar properties. As to forming the seal 14, it may involve putting a set of pliers with a forming tool on the seal 12 and pressing it. Afterward, embossing 15 (FIG. 4) may be done and at the other end, rivet 11 may be curved or flanged to secure component 21 (FIG. 2) to plate 16 through an opening, such as a slot, a hole 36 (FIG. 7), or the like, in plate 16, as well as to fixture 22.

Figure 4:
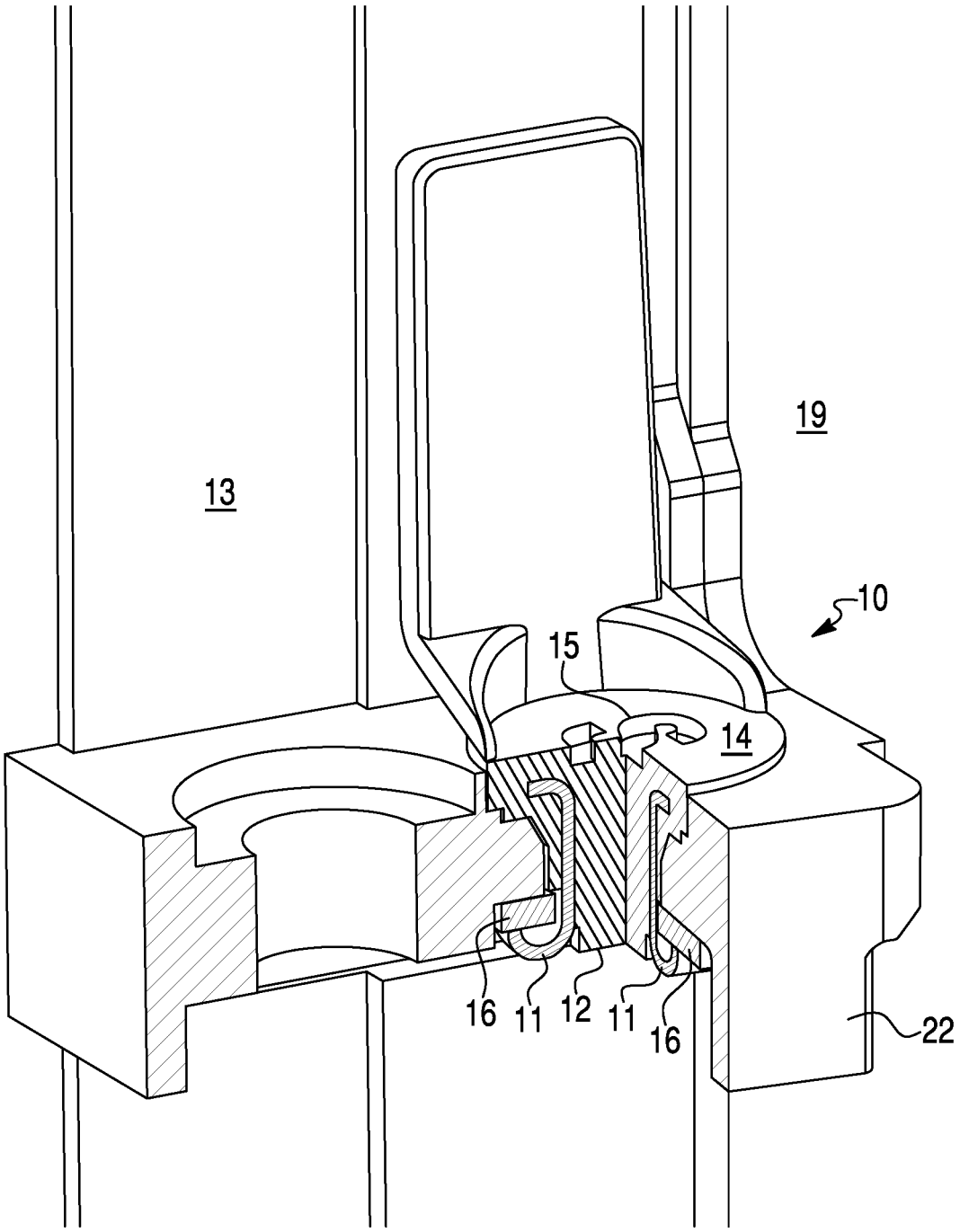
FIG. 4 is a diagram of a top view with a cut-out showing a lower portion of a rivet flared or curved up against a plate attached to a meter to secure the seal assembly through which rivet is situated.

FIG. 4 is a diagram of a top view with a cut out showing a lower portion of rivet 11 flared or curved up against a plate 16 attached to meter 19 to secure the seal assembly 10 through which rivet 11 is situated. Surface 14 may have an embossment 15 formed on it. The bottom of rivet 11 may be flanged or curved manually or automatically. In either case, a riveting tool may be needed.

Figure 5:
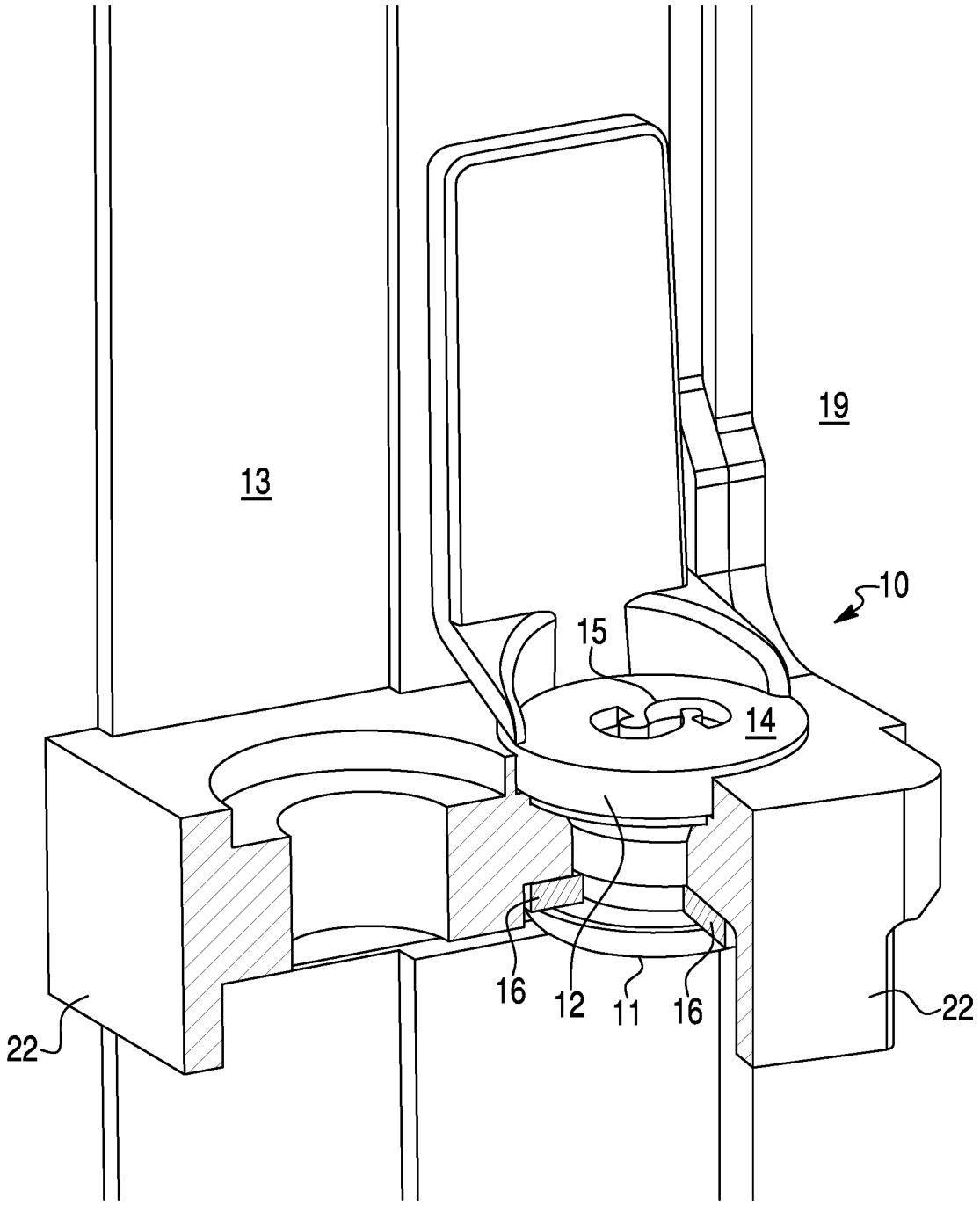
FIG. 5 is a diagram of a top view of the seal assembly having been sealed as shown by the turned up bottom of a tubular rivet.

FIG. 5 is a diagram of a top view of seal assembly 10 having been sealed as shown by the turned up bottom of tubular rivet 11.

Figure 6:
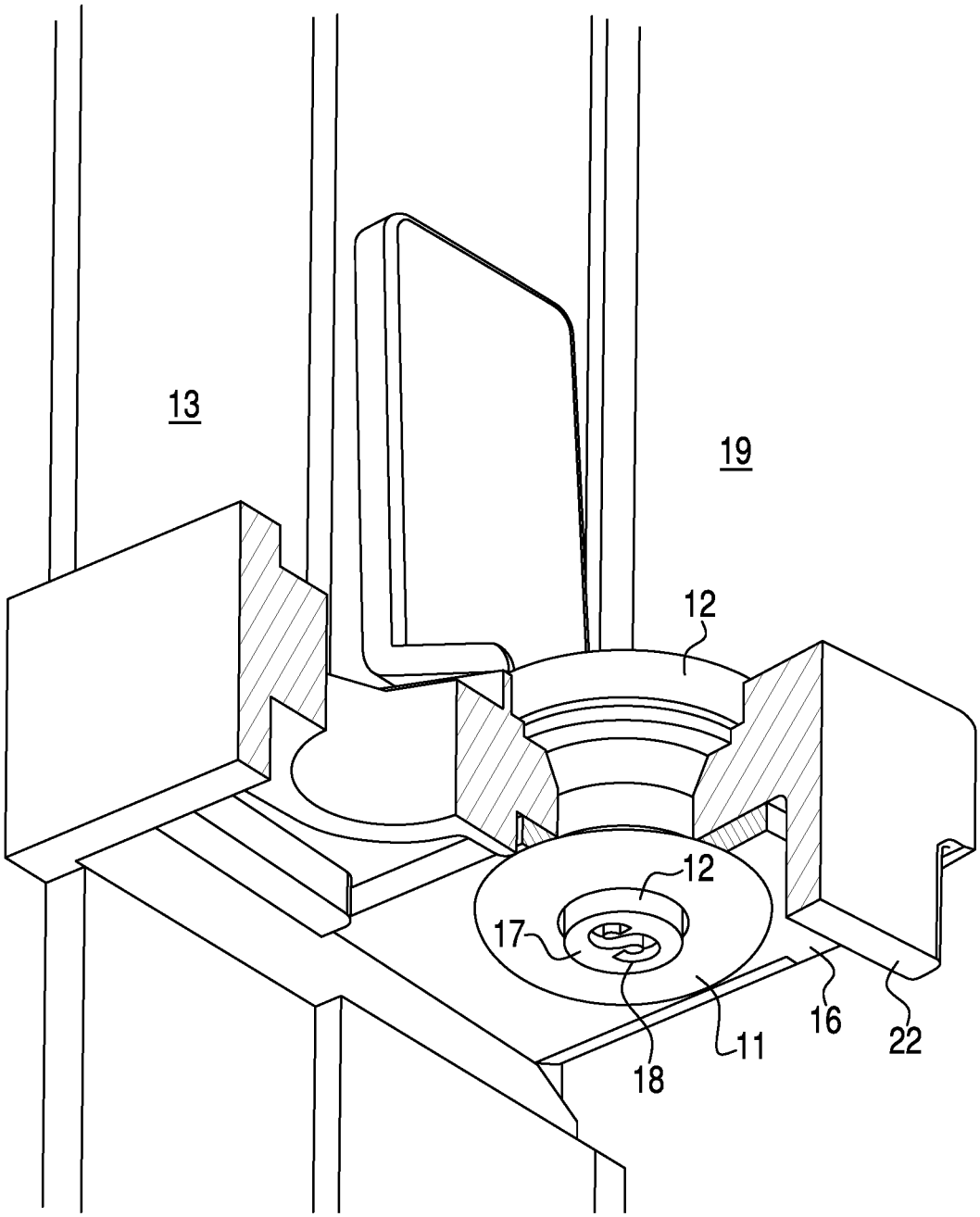
FIG. 6 is a diagram of a bottom view of the tubular rivet with a component protruding at a center of the rivet, and having a surface with an embossment.

FIG. 6 is a diagram of a bottom view of tubular rivet 11 with component 12 protruding at the center of rivet 11, and having a surface 17 with an embossment 18.

Figure 7:
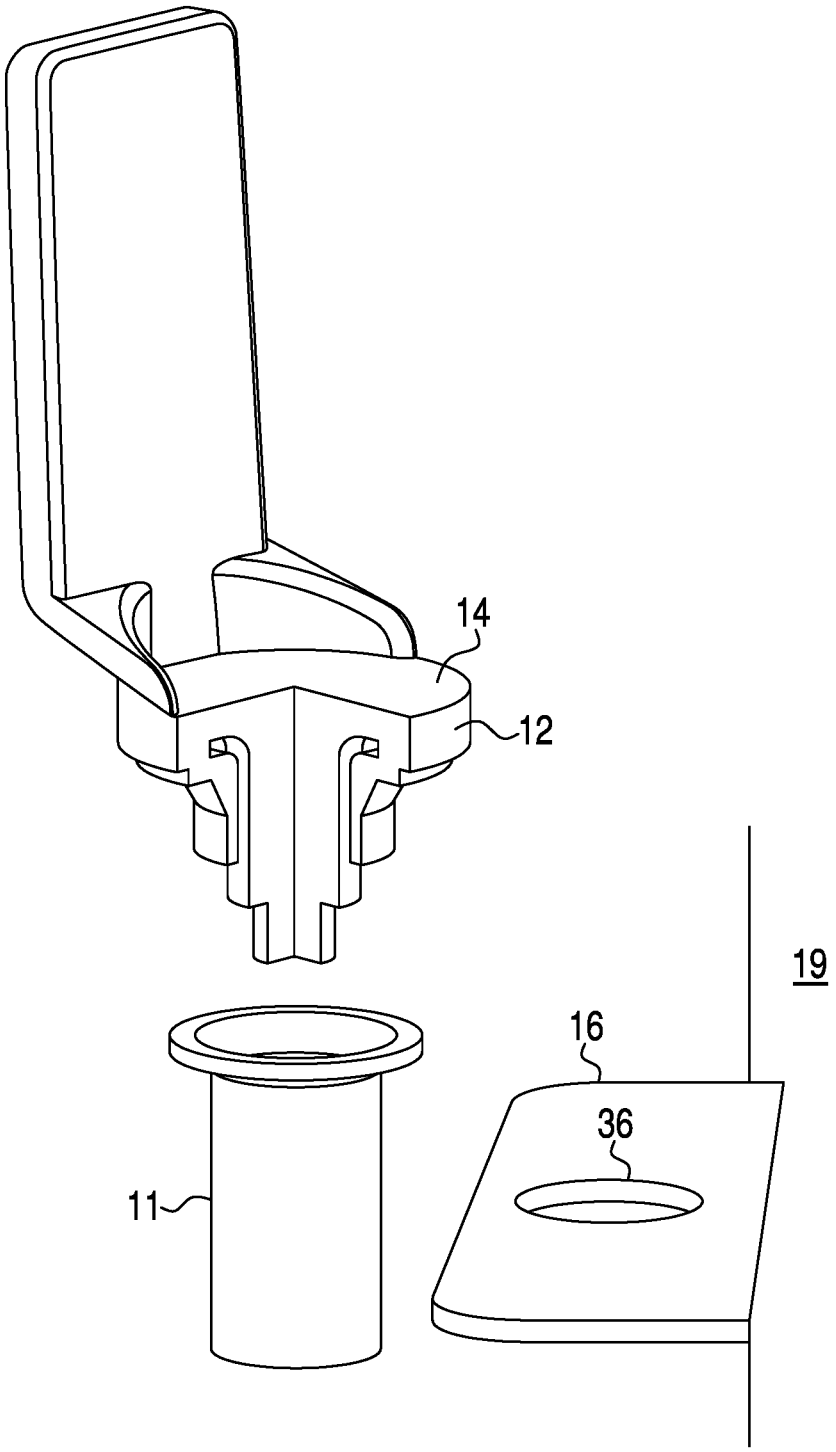
FIG. 7 is a diagram of an illustrative exploded view of the assembly with the rivet separated from the plastic-like component.

FIG. 7 is a diagram of an illustrative exploded view of assembly 10 with rivet 11 separated from plastic-like component 12 and plate 16 with an opening or hole 36.

Figure 8:
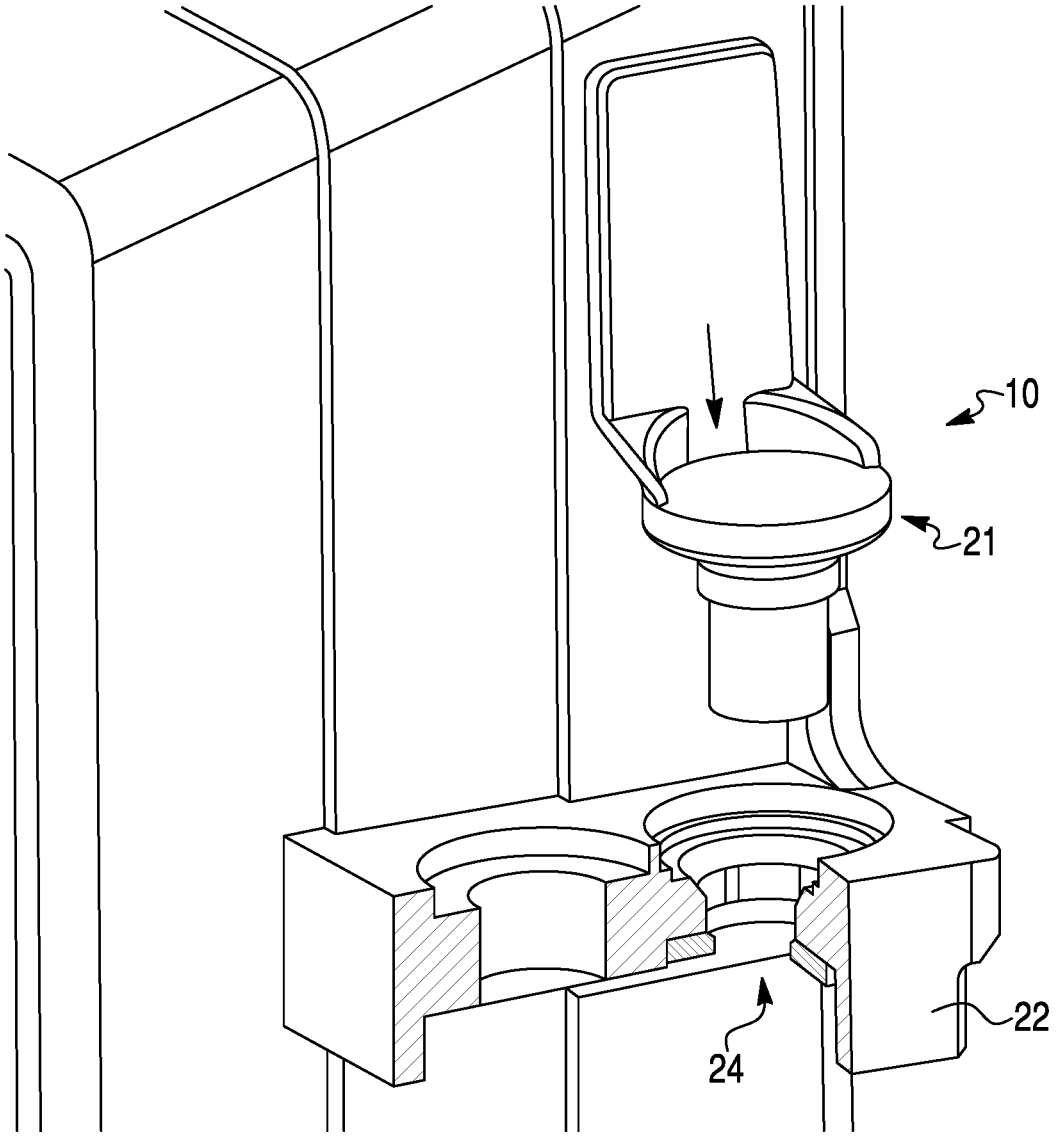
FIG. 8 is a diagram of an illustrative exploded view of the rivet seal assembly separated from the index of a meter.

FIG. 8 is a diagram of an illustrative exploded view of rivet seal assembly 10 with component 21 separated from component 22 and index 13 of meter 19, and direction of movement of component 21 to secure assembly 10.

Figure 9:
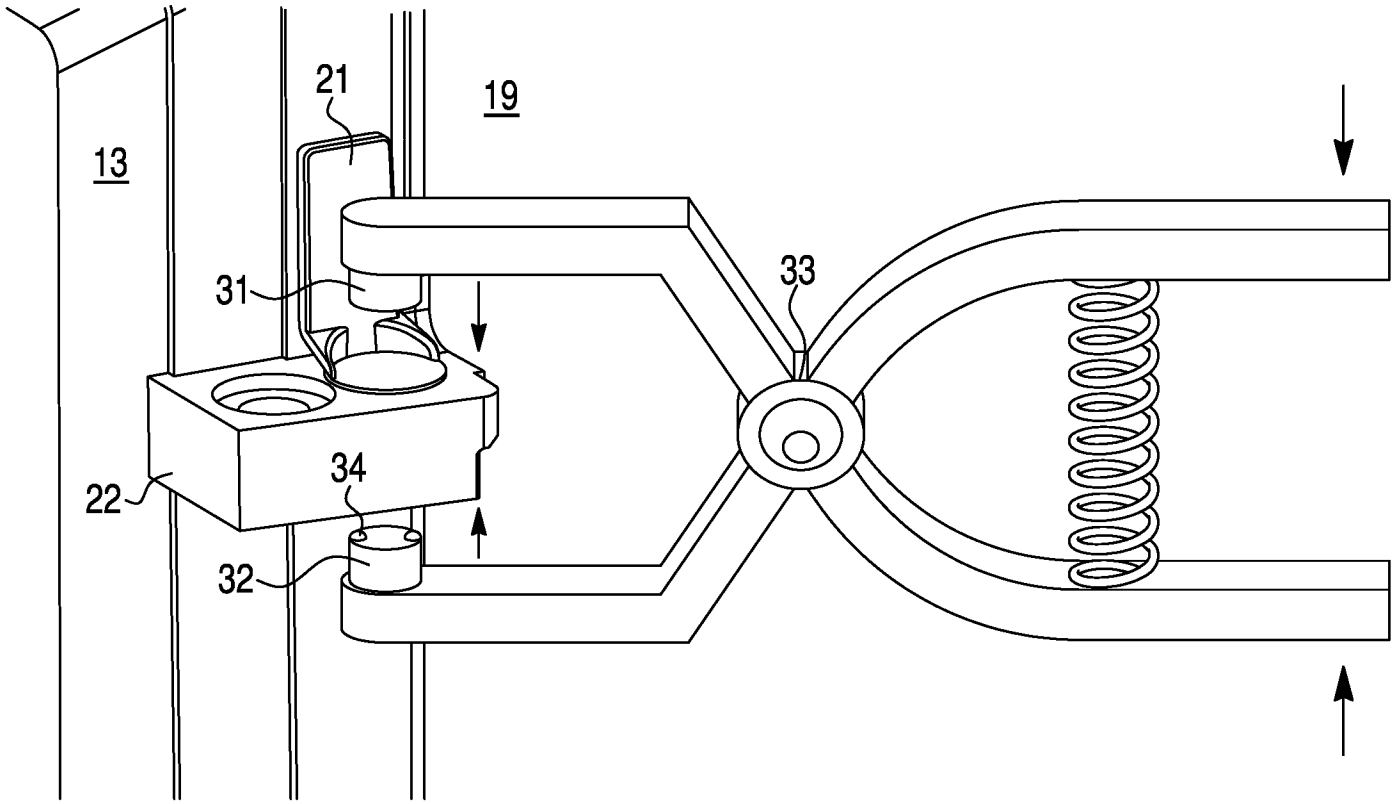
FIG. 9 is a diagram of a layout with a tool that maybe implemented for embossing emblems on plastic-like material surfaces of the assembly.

FIG. 9 is a diagram of a layout that maybe implemented for embossing emblems 15 and 18 on the plastic-like material 12 surfaces 14 and 17, respectfully. A set of pliers 33 may be used to press seal or component 21 in to hole or receptacle 24 of structure 22. A die 31 on one plier of set 33 may provide an embossment 15 on surface 14 while pushing component 21 into receptacle 24 (FIG. 8). At the same time, a die 32 may provide an embossment 18 on surface 17 with a force of an opposite direction of that of die 31 (FIG. 9). Associated with die 32 may be tool 34 that bends the end of rivet 11 into a flange that is formed firmly against plate 16.

Figure 10:
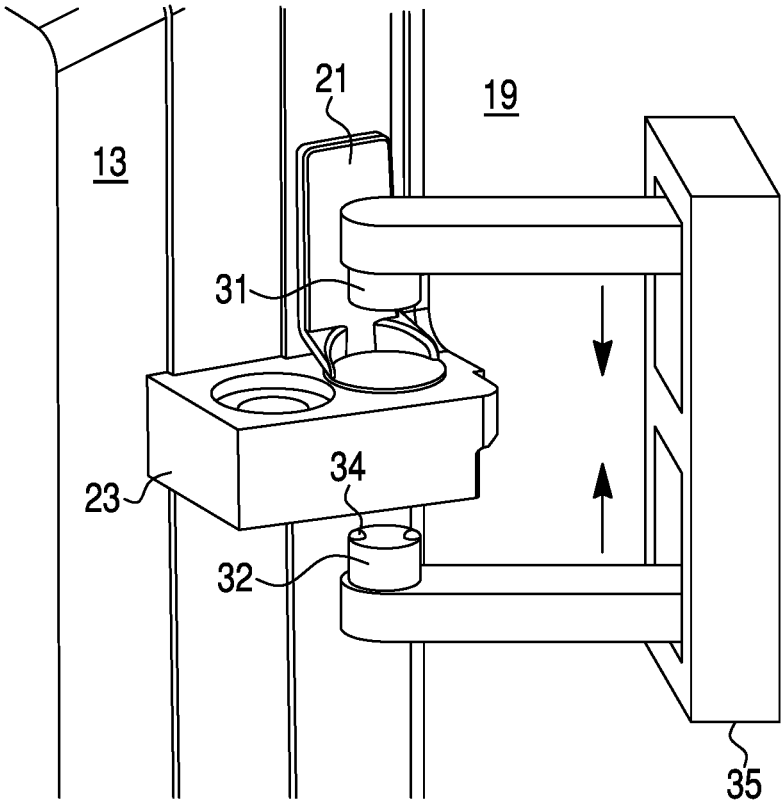
FIG. 10 is a diagram like that of FIG. 9 that may achieve the same results except that they may be accomplished with a machine rather than manually.

FIG. 10 is a diagram like that of FIG. 9 which may achieve the same results except that they may be accomplished with a machine 35 rather than manually with set 33 of pliers. Machine 35 may operate automatically and in certain situations also be also a part of an assembly line.

Figure 11:
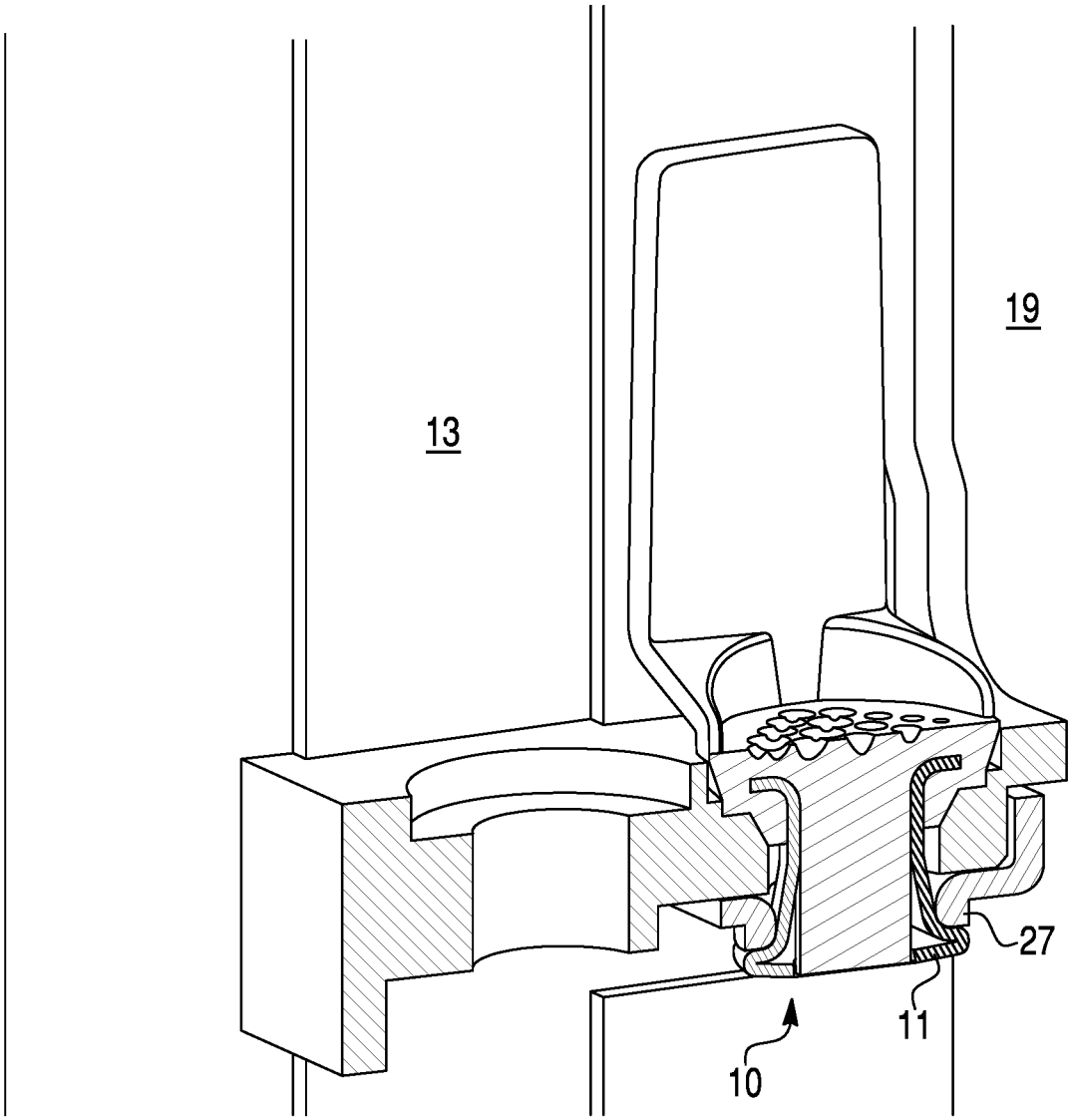
FIG. 11 is a diagram of an option for the assembly that may incorporate a collar to an area where the rivet is flanged.

FIG. 11 is a diagram of an option for assembly 10 that may be to add a collar 27 to an area where rivet 11 is flanged. Collar 27 may cover rivet 11 in a way that makes it difficult to cut rivet 11 off. Collar 27 may be attached to or be a part of gas meter 19.

To recap, a tamper proof locking mechanism may incorporate a first fixture for attachment to an index protective cover, a second fixture for attachment to an instrument, and a third fixture for connecting the first fixture to the second fixture. The first fixture may incorporate a receptacle. The second fixture may incorporate a plate with an opening. The third fixture may incorporate a protrusive structure that fits into the receptacle of the first fixture and into the opening in the plate to connect the first fixture to the second fixture. The protrusive structure may incorporate a rivet that is partially embedded with a plastic-like or marker technology material that reveals tampering when an attempt is made to break a connection between the first fixture and the second fixture.

The protrusive structure may have an embossment of a pattern on a surface of plastic-like material at a first end. An attempt or success to affect the protrusive structure to break the connection of the first fixture and the second fixture, may result in a distortion of the pattern embossed on the surface at the first end of the protrusive structure.

The protrusive structure may have a second end that reveals the rivet to have a flanged end.

The mechanism may further incorporate a collar that is situated around the flanged end of the rivet to prevent removal of the flanged end of the rivet or the rivet.

The collar may be attachable to the instrument.

The rivet at the flanged end may be a plastic-like material surface of the protrusive structure having an embossment of a pattern.

Of the mechanism, the instrument may be a meter, and the index protective cover may be for the meter.

The first fixture may incorporate one or more additional receptacles.

The protrusive structure may be fabricated with a plastic-like material molded to fit in an inside form of the receptacle of the first fixture.

An approach for a tamper proof connection may incorporate attaching a receptacle fixture to a first apparatus, obtaining a second apparatus with a plate, having an opening, connecting the first apparatus to the second apparatus by inserting the plate into the receptacle fixture, and inserting a protruding structure into the receptacle and through the opening of the plate to connect the receptacle fixture to the plate, and thus resulting in a connection of the first apparatus and the second apparatus to each other. The protruding structure may incorporate a rivet having a portion on an outside surface of the rivet wrapped with a plastic-like material and having plastic-like material internally in the rivet, and having plastic-like material molded with a surface over a first end of the rivet and molded with a surface at a second end of the rivet. The rivet may secure the receptacle by being inserted in the opening of the plate. The surface over the first end of the rivet may be embossed with a pattern. The second end of the rivet may be flanged toward the surface of the receptacle to prevent removal of the rivet from the opening of the plate. An attempted or actual removal of the rivet to eliminate the connection between the receptacle and plate may indicate a tampering according to a distortion of the pattern embossed in the surface of the plastic-like material over the first end of the rivet.

The approach may further incorporate embossing a pattern on a surface of plastic-like material at the second end of the rivet.

The attempted or actual removal of the rivet from the opening in the plate may indicate a tampering according to a distortion of the pattern embossed on the surface at the second end of the rivet.

The approach may further incorporate placing a collar around the second end of the rivet. The collar may be attached to the second apparatus.

The collar, the rivet and the plate may be composed of a hardened metal-like material, e.g., steel.

The surface over the first end of the rivet may be embossed with a pattern, the surface of the second end of the rivet embossed with a pattern, and the second end of the rivet flanged with a set of pliers. The pattern for the surface over the first end of the rivet may be on a first die situated on a first jaw of the set of pliers. The pattern for the surface over the second end of the rivet may be on a second die situated on a second jaw of the set of pliers. The second jaw of the set of pliers may have a component around the second die for flanging the second end of the rivet. The set of pliers may be aligned with the rivet so that when the pliers are closed, the first die embosses the surface at the first end of the rivet, the second die embosses the surface at the second end of the rivet, and the component around the second die flanges the second end of the rivet, so as to seal the protruding structure to the receptacle fixture with the rivet securing the plate via the opening in the plate.

A tamper proof lock may incorporate a plate having a hole or opening for attachment to a first mechanism, a receptacle structure for attachment to a second mechanism, and a partially coated rivet pressed into the receptacle structure to lock the plate and the receptacle structure together. The partially coated rivet may have a malleable plastic-like material that is molded as a coating on the rivet in the receptacle upon the rivet being pressed into the receptacle as a seal. An insertion of at least a portion of the rivet into the hole or opening of the plate may lock the plate and the receptacle structure together. A surface of the plastic-like material at first end of the rivet may be embossed with pattern.

The material may be of marker technology.

The pattern may reveal distortion upon a tampering of the receptacle structure, plate, or the rivet.

A second end of the rivet may be flanged towards the plate to secure the rivet to the plate to better prevent unlocking the plate and the receptacle structure from each other.

The lock may further incorporate a collar covering at least a portion of a flanged second end of the rivet, as an obstacle to removal of the rivet or to an elimination of a locking of the plate and the receptacle structure to each other.

Of the lock, the instrument may be a gas meter, and the second instrument may be a meter index cover.

Any publication or patent document that may be noted herein is hereby incorporated by reference to the same extent as if each individual publication or patent document was specifically and individually indicated to be incorporated by reference.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A method for a tamper proof connection comprising:

attaching a receptacle fixture to a first apparatus;

obtaining a second apparatus with a plate, having an opening;

connecting the first apparatus to the second apparatus by:

inserting the plate into the receptacle fixture; and inserting a protruding structure into the receptacle and through the opening of the plate to connect the receptacle fixture to the plate, and thus resulting in a connection of the first apparatus and the second apparatus to each other; and wherein:

the protruding structure comprises a rivet having a portion on an outside surface of the rivet wrapped with a plastic material and having the plastic material internally in the rivet, and having the plastic material molded with a surface over a first end of the rivet and molded with a surface at a second end of the rivet;

the rivet secures the receptacle by being inserted in the opening of the plate;

the surface over the first end of the rivet is embossed with a pattern;

the second end of the rivet is flanged toward the surface of the receptacle to prevent removal of the rivet from the opening of the plate; and an attempted or actual removal of the rivet to eliminate the connection between the receptacle and plate indicates a tampering according to a distortion of the pattern embossed in the surface of the plastic material over the first end of the rivet.

2. The method of claim 1, further comprising embossing a pattern on a surface of the plastic material at the second end of the rivet.

3. The method of claim 2, wherein the attempted or actual removal of the rivet from the opening in the plate indicates a tampering according to a distortion of the pattern embossed on the surface at the second end of the rivet.

4. The method of claim 2, wherein:

the surface over the first end of the rivet is embossed with a pattern, the surface of the second end of the rivet embossed with a pattern, and the second end of the rivet flanged with a set of pliers;

the pattern for the surface over the first end of the rivet is on a first die situated on a first jaw of the set of pliers;

the pattern for the surface over the second end of the rivet is on a second die situated on a second jaw of the set of pliers;

the second jaw of the set of pliers has a component around the second die for flanging the second end of the rivet; and the set of pliers are aligned with the rivet so that when the pliers are closed, the first die embosses the surface at the first end of the rivet, the second die embosses the surface at the second end of the rivet, and the component around the second die flanges the second end of the rivet, so as to seal the protruding structure to the receptacle fixture with the rivet securing the plate via the opening in the plate.

5. The method of claim 1, further comprising:

placing a collar around the second end of the rivet; and wherein the collar is attached to or a part of the second apparatus.

6. The method of claim 5, wherein the collar, the rivet and the plate are composed of a hardened metal material.

* * * * *